United States Patent [19]

Kitano

[11] Patent Number: 4,699,860

[45] Date of Patent: Oct. 13, 1987

[54] PHOTOSENSITIVE MEMBER AND PROCESS FOR FORMING IMAGES WITH USE OF THE PHOTOSENSITIVE MEMBER HAVING AN AMORPHOUS SILICON GERMANIUM LAYER

[75] Inventor: Hirohisa Kitano, Osaka, Japan

[73] Assignee: Minolta Camera Kabushiki Kaisha, Osaka, Japan

[21] Appl. No.: 753,404

[22] Filed: Jul. 10, 1985

[30] Foreign Application Priority Data

Jul. 20, 1984 [JP] Japan ..... 59-151769

[51] Int. Cl.[4] ..... G03G 5/085

[52] U.S. Cl. ..... 430/57; 430/63; 430/65

[58] Field of Search ..... 430/60, 57, 63, 65

[56] References Cited

U.S. PATENT DOCUMENTS

| | | | |
|---|---|---|---|
| 4,452,874 | 6/1984 | Ogawa et al. | 430/57 |
| 4,465,750 | 8/1984 | Ogawa et al. | 430/57 |
| 4,522,905 | 6/1985 | Ogawa et al. | 430/60 |

*Primary Examiner*—John L. Goodrow

*Attorney, Agent, or Firm*—Burns, Doane, Swecker & Mathis

[57] ABSTRACT

The present invention relates to a photosensitive member which comprises on a conductive substrate a first layer of amorphous silicon: germanium; a second layer of amorphous silicon with a rectifying property and a third layer of amorphous silicon. Using this photosensitive member, an image is formed by charging, exposing to a light of short wavelength, exposing to an optical image of long wavelength to form a latent image and developing the latent image. This latent image can be repeatedly used to form a plurality of copies.

7 Claims, 13 Drawing Figures

PHOTOSENSITIVE MEMBER AND PROCESS FOR FORMING IMAGES WITH USE OF THE PHOTOSENSITIVE MEMBER HAVING AN AMORPHOUS SILICON GERMANIUM LAYER

BACKGROUND OF THE INVENTION

The present invention relates to a photosensitive member wherein amorphous silicon is used as its photoconductive material and to a process for forming images using the photosensitive member.

For the past several years, attention has been focused on the application to photosensitive members of amorphous silicon (hereinafter referred to as "a-Si") which is produced by the glow discharge decomposition process or sputtering process. Similarly attention has been directed to amorphous silicon-germanium (hereinafter referred to as "a-Si:Ge") having improved sensitivity in the region of long wavelengths for use in forming images by a semiconductor laser. Such promising application is attributable to the fact that for use in photosensitive members, a-Si and a-Si:Ge are exceedingly superior to the conventional selenium and CdS materials in resistance to environmental pollution, heat and abrasion, photosensitive characteristics, etc.

However, a-Si or a-Si:Ge has the drawback of being low in dark resistivity and unusable as it is for the photoconductive layer serving also as a charge retaining layer. It has therefore been proposed to incorporate oxygen or nitrogen into the material to improve the dark resistivity, but this conversely results in reduced photosensitivity, hence there is a limit to the content of the additive Accordingly it is proposed to give improved charge retentivity by forming over the photoconductive layer a light-transmitting a-Si insulation layer having oxygen or carbon incorporated therein (e.g. U.S Pat. No. 4,465,750). Nevertheless, improved chargeability requires a higher carbon concentration, which needs to be at least 70 atomic % in some cases. Overcoat layers of such high carbon concentration are difficult to make by the common glow discharge decomposition process Moreover, the overcoat layer, if obtained with a high carbon concentration, exhibits poor adhesion to the photoconductive layer (of a-Si or a-Si:Ge), possibly permitting the photosensitive member to create blank streaks in the copy images produced. Thus, there is a limitation to the improvement of chargeability by increasing the carbon content.

When the photosensitive member having an a-Si or a-Si:Ge photoconductive layer is used for forming copy images by common xerography, electrostatic latent images are formed on the surface of the photosensitive member. In other words, the electrostatic latent image is formed by the charges retained on the surface. However, since the member is low in charge retentivity as stated above, the surface charges readily disappear or decay, failing to give a satisfactory copy image. Especially it is diffucult to obtain a multiplicity of copies from a single electrostatic latent image.

SUMMARY OF THE INVENTION

The main object of the present invention is to provide a photosensitive member for forming copy images of good quality and an image forming process therefor.

Another object of the present invention is to provide a photosensitive member suitable for use in a printer wherein a semiconductor laser or the like for emitting light of long wavelength is used as an exposure light source.

Another object of the present invention is to provide a process for forming satisfactory copy images without retaining electrostatic latent images on the surface of the photosensitive member.

Still another object of the present invention is provide an image forming process which is capable of producing a plurality of copy images continually by repeatedly using the same electrostatic latent image.

DETAILED DESCRIPTION OF THE INVENTION

Figure 1:
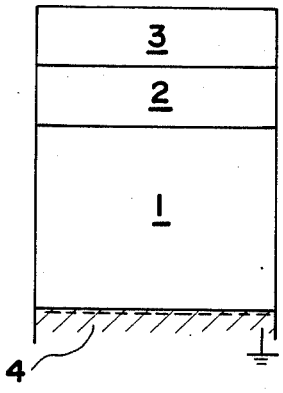
FIG. 1 is a diagram schematically showing the structure of a photosensitive member according to the present invention.

With reference to FIG. 1 showing the structure of a photosensitive member embodying the present invention, the member comprises an electrically conductive substrate 4 made, for example, of aluminum, a layer 1 (hereinafter referred to as "first layer") formed on the substrate and including a-Si as a main constituent, a rectifying layer 2 (hereinafter referred to as "second layer") which is formed on the first layer and in which charges of the same polarity as the polarity of charging serve as the minority carrier, and a surface layer 3 (hereinafter referred to as "third layer") formed over the second layer and including a-Si as a main constituent.

The first layer 1, which comprises a matrix of a-Si, usually needs to be 10 to 100 μm in thickness. If it is thinner, sufficient chargeability will not be obtained, whereas larger thicknesses are disadvantageous in production cost. It is desirable to incorporate germanium into the entire first layer or to provide a germanium-containing layer (a-Si:Ge layer) within the first layer The a-Si:Ge layer has high ability to absorb light of long wavelengths (of not shorter than 700 nm) such as laser light, effectively absorbing the laser light passing through the third and second layers to produce charge carriers. As will be apparent from the description to be given later, light of long wavelength such as laser is used in the present invention for forming images, so that it is desirable to incorporate Ge into the first layer 1.

As mentioned above, Ge may be contained throughout the entire first layer or may be present locally in this layer. In either case, it is preferred that the a-Si:Ge layer be 100 Å to 40 μm in thickness. If the thickness is smaller than 100 Å, it is impossible to expect the a-Si:G layer to achieve a sufficient improvement in sensitivity to light of long wavelength Further when the thickness exceeds 40 μm, optical fatigue is likely to occur, with a tendency for the residual potential to rise.

The concentration of Ge atoms in the a-Si:Ge layer should be 2 to 70 atomic % (hereinafter abbreviated as "at. %"), more preferably 5 to 50 at. %, based on the total number of Si atoms and Ge atoms. If the Ge concentration is lower, the layer may have a larger thickness than 40 μm Other element, such as carbon, boron or nitrogen, may further be incorporated into the first layer to impart improved optical characteristics to the layer. Introduction of oxygen is effective in respect of chargeability. Preferably, 0.01 to 5 at. % of oxygen is present based on Si.

An element from Group IIIA or Group VA of the Periodic Table may be incorporated into the first layer to adjust the polarity thereof. Boron is especially suited as the Group IIIA element, while phosphorus is particularly preferred as the Group VA element.

Based on the element Si, up to 200 ppm, preferably 5 to 100 ppm, of the Group IIIA element is introduced into the first layer, or up to 50 ppm, preferably 1 to 20 ppm, of the Group VA element is used.

The presence of the Group IIIA or VA element in the first layer 1 adjusts the first layer in polarity to facilitate transport of holes or electrons More specifically, the first layer becomes n type when containing the Group VA element or a small amount (e.g. up to 20 ppm) of the Group IIIA element, or the layer becomes p type when containing a larger amount of the Group IIIA element, the layer being of the intrinsic type at the boundary between these amounts, although the type of the layer is further dependent on the production conditions.

The second layer 2, which comprises a matrix of a-Si, serves as a rectifying layer wherein charges of the same polarity as that of charging act as the minority carrier. For example, when the photosensitive member is used as charged positively, up to 20 ppm of an element of Group IIIA, e.g. boron, is incorporated into the layer 2, or up to 50 ppm of an element in Group VA, e.g. phosphorus, is added, for the adjustment of polarity. Further when the member is used as charged negatively, more than 20 ppm of a Group IIIA element, e.g. boron, is added to the layer. The second layer 2 further contains at least one of oxygen, carbon and nitrogen The second layer 2, having rectifying properties, traps the carriers produced in the third layer, exhibiting the function of retaining charges. On the other hand, the second layer assures the carriers produced in the first layer of their transportability, thereby functioning to decay charges. For a continuous copying operation, therefore, it is most important for the second layer 2 to fully retain the charges produced in the third layer 3. Accordingly it is required to give the second layer 2 an improved charge retaining function (injection of no positive charges into the first layer in positive charging) insofar as transport of charges produced in the first layer 1 will not be greatly inhibited.

To fulfill both the requirements in respect of charge retention and light decay functions, it appears useful to fully intensify the polarity of the second layer 2 (strong n type in the case of positive charging), but if a large amount of dopant is present for such polarity adjustment, a shallow impurity level will increase in the forbidden band, increasing the likelihood of thermally excited carriers occurring and consequently making it difficult to retain sufficient charges owing to a marked reduction in the dark resistivity of the layer itself despite intensified rectifying properties.

In view of the above problem, it is critical not to lower, or rather to enhance, the resistivity of the layer itself to an extent which will not be objectionable to the rectifying properties.

Examples of additive elements which are useful for this purpose are oxygen, carbon and nitrogen. Oxygen greatly improves the resistivity of the layer itself, but an excess of this element impairs the transportability of charges. Although carbon will not be as effective as oxygen for improving the resistivity, carbon has the feature of being unlikely to impair the transportability of charges even if used in a relatively large amount for doping. Nitrogen acts as a polarity adjusting agent (to give n type) when used in a small amount and affords improved resistivity when used in a larger amount.

The optimum amounts of these elements to be used singly differ from those to be used in combination, but it is generally suitable to use 0.01 to 50 at. % of oxygen, 0.1 to 60 at. % of carbon and 0.1 to 10 at. % of nitrogen.

The thickness of the second layer 2 is dependent also on the charge retentivity and the transportability of carriers from the first layer. Accordingly, although the optimum thickness varies with the composition selected, the second layer must have a thickness of at least 1000 Å if smallest so that the charges injected through the surface by irradiation with light of short wavelength will not decay during development and transfer.

Since the present photosensitive member has the function of blocking by the rectifying layer the carriers resulting from the absorption of light of short wavelength by the third layer, the member is usable in the usual Carlson process also for the purpose of giving improved reproducibility of blue color by suitably cutting the sensitivity to blue.

According to the present invention, it is required that the first layer 1 be set to a polarity at least weaker than the polarity of the second layer which is determined according to the polarity of charging. Preferably the polarity is so adjusted as to afford the intrinsic region, for example, by doping the layer with an element from Group IIIA, e.g. boron Although the amount of $B_2H_6$ to be added generally varies with the plasma condition, the amount should be about 10 to about 100 ppm. At this time, oxygen, carbon or nitrogen may be present conjointly to provide improved optical characteristics.

The third layer 3, which also comprises a matrix of a-Si, functions to absorb light of short wavelengths of 400 to 500 nm to produce charge carriers. Like the first layer 1, the third layer may contain an element in Group IIIA or Group VA. The content of the Group IIIA element is up to 200 ppm, preferably 5 to 100 ppm, while the Group VA element is to be present in an amount of up to 50 ppm, preferably 1 to 20 ppm. The thickness of the third layer 3 is such that the light of short wavelengths can be absorbed almost substantially and is preferably 0.5 to 5 μm. The third layer 3 may further contain up to 5 at. % of oxygen, nitrogen or carbon.

The photosensitive member of the present invention may include a charge injection preventing layer between the substrate 4 and the first layer 1. This layer contains at least one of carbon and oxygen as incorporated in a-Si. It is suitable that the carbon content be 5 to 60 at. %, and that the oxygen content be 0.01 to 40 at. %. Further the polarity of the layer may be so adjusted that charges of a polarity opposite to that of the charges to be led toward the electrically conductive substrate on charging will be the majority carrier. The charge injection preventing layer is preferably 30 Å to 2.0 μm in thickness.

The photosensitive member of the present invention may further be provided with a surface protecting layer over the third layer 3 to prevent reflection and give durability with improved stability. This layer is formed of carbon-containing a-Si. Suitably, the carbon content is 5 to 70 at. %. When required, the layer may further contain up to 10 at. % of oxygen. Preferably, the surface protecting layer is 0.01 to 3 μm in thickness.

Figure 2:
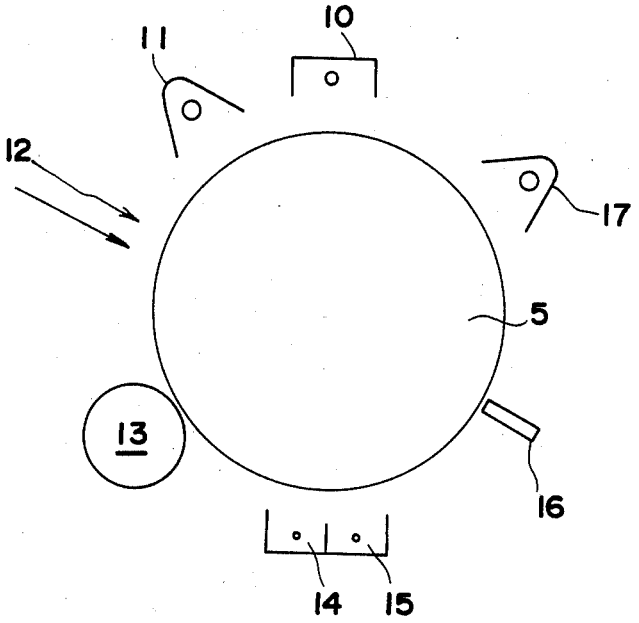
FIG. 2 is a diagram schematically showing a printer incorporating the photosensitive member of FIG. 1 and adapted to practice the image forming process of the present invention.

FIG. 2 schematically shows a printer adapted to practice the image forming process of the present invention. Indicated at 5 in the diagram is the photosensitive member shown in FIG. 1. While being drivingly rotated counterclockwise, the member is charged by a corona charger 10 to a predetermined polarity. An exposure light source 11 emits light of short wavelength of about 400 to 500 nm to irradiate the entire surface of the member 5. Indicated at 12 is an exposure light source for giving off light of long wavelength of at least about 700 nm, such as a semiconductor laser, to expose the photosensitive surface to an optical image and thereby form an electrostatic latent image. The latent image is developed by developing means 13 to a toner image, which is subsequently transferred to copy paper by a transfer charger 14. The copy paper is separated from the photosensitive member 5 by a separating charger 15. The toner remaining on the member 5 is removed by a cleaning blade 16. The residual charges on the member 5 are erased by an eraser lamp 17 which emits light of long wavelength (at least 700 nm).

The image forming process of the present invention is practiced by the printer of above construction through the steps illustrated in FIGS. 3*a* to 3*h*.

Figure 3D:
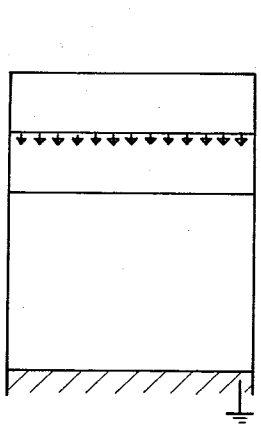
FIGS. 3*a* to 3*h* are diagrams showing the image forming process of the invention from step to step.
Figure 3C:
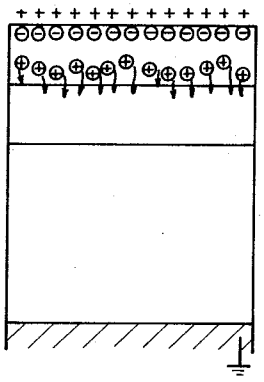
Figure 3B:
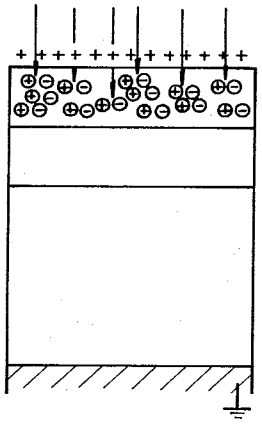
Figure 3A:
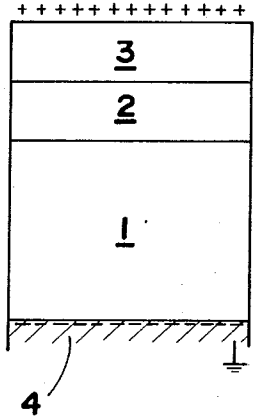

In the first step shown in FIG. 3*a*, the photosensitive member 5 is charged by the corona charger 10, for example, to positive polarity, whereby the member 5 is charged to a predetermined surface potential.

In the following second step, the charged member 5 is entirely irradiated with light of wavelength of 400 to 500 nm by the short-wavelength light source 11. The light is substantially absorbed by the third layer 3, and holes and electrons are produced as seen in FIG. 3*b*. The electrons produced drift toward the positively charged surface of the third layer 3 and combine with the surface charges (FIG. 3*c*). On the other hand, the holes produced move toward the substrate. Toward the direction of movement of the holes, however, there is the second layer 2 wherein holes are the minority carrier, with the result that the holes are very likely to be trapped without being allowed to move toward the first layer. Thus, the holes remain as residual charges in the vicinity of the interface between the second layer 2 and the third layer 3. FIG. 3*d* shows the result; it is seen that the holes are uniformly trapped at the interface between the second layer and the third layer.

Figure 3E:
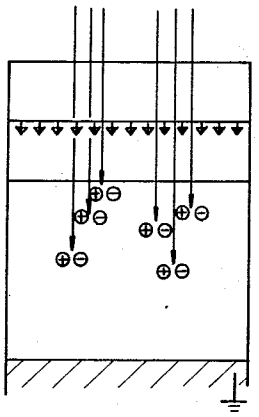
Figure 3F:
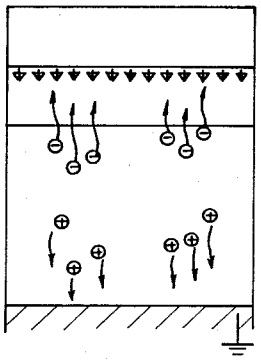
Figure 3G:
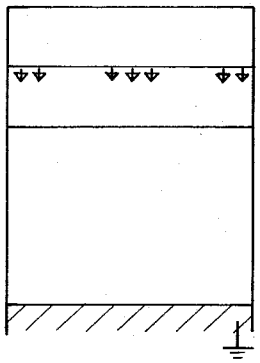

In the third step, the member 5 is exposed to an optical image by the long-wavelength light source 12 such as a semiconductor laser. Because the wavelength energy of the light of long wavelength is smaller than the optical band gap of a-Si, the light incident on the surface of the third layer is absorbed by the third layer 3 and the second layer 2 only slightly and almost entirely passes through these layers to the first layer 1. Moreover, since the positive charges resulting from the exposure of the second step with the light of short wavelength are trapped in the second layer, the electric field within the photosensitive member 5 is most intense in the first layer. Accordingly, when the first layer has a sufficiently larger thickness than the second and third layers, almost all effective photo-carriers (electron-hole pairs) occur within the first layer (FIG. 3*e*). Under the electric field acting on the electron-hole pairs, these electrons and holes drift. Consequently, the holes recombine with the electrons induced in the substrate, while the electrons drift toward the second layer (FIG. 3*f*). Since electrons are the majority carrier in the second layer, these electrons are easily movable therein to recombine with the holes trapped at the interface between the second layer and the third layer, forming an electrostatic latent image (FIG. 3*g*).

In the subsequent fourth step, the latent image is developed into a toner image by the developing means 13. The latent image can be developed by a known process, such as the magnetic brush process or cascade process.

The toner image obtained is then transferred by the transfer charger 14 to copy paper, which is then separated from the photosensitive member 5 by the separating charger 15. The toner remaining on the member is removed by the cleaning blade 15. The member 5 is then irradiated by the eraser lamp 17 for the removal of the residual charges. Since light of long wavelength is used for the irradiation, the light is absorbed by the first layer 1, and the holes trapped in the second layer are reliably neutralized.

Figure 3H:
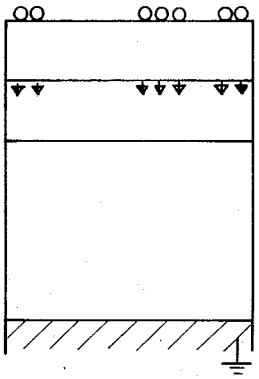

According to the present invention, the electrostatic latent image is formed not on the surface layer (third layer) but in the interior of the photosensitive member (second layer). This reduces the loss of charges during the developing and transfer steps and makes it possible to use the latent image formed by the exposure of the third step for producing a plurality of copies by a continuous operation. More specifically, the electrostatic latent image formed as shown in FIG. 3*g* is developed as seen in FIG. 3*h* and can be thereafter developed repeatedly with the eraser lamp 17 held out of operation. Accordingly, when it is desired to copy the same image repeatedly, the first to fourth steps are performed and, after the toner image has been transferred by the transfer charger 14 for the first copy, removal of toner by the cleaning blade 16, development by the developing means 13, transfer of the toner image by the transfer charger 14 and separation of paper by the separating charger 15 alone are repeated. After the desired number of copies have been made, the photosensitive member is irradiated by the eraser lamp 17.

Subsequent to the formation of the latent image of FIG. 3*g*, the photosensitive member may be exposed to an image by another long-wavelength light source, in corresponding relation to the portion of the second layer 2 where the holes are trapped, whereby a composite electrostatic latent image including the additional image can be formed.

EXAMPLE 1

Figure 6:
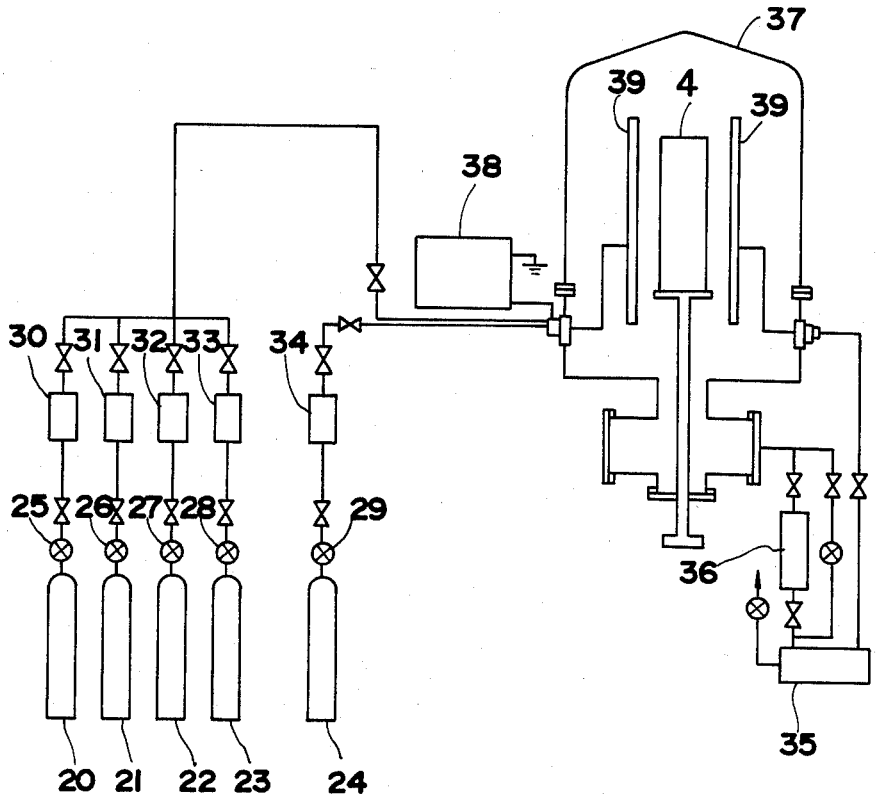
FIG. 6 is a diagram schematically showing the construction of a glow discharge decomposition apparatus for producing the photosensitive member of the invention.

With reference to FIG. 6 showing a glow discharge decomposition apparatus, first a rotary pump 35 and then a diffusion pump 36 were operated to evacuate the interior of a reaction chamber 37 to a high vacuum of about $10^{-6}$ torr. Subsequently, first to third and fifth regulator valves 25, 26, 27, 29 were opened to introduce $H_2$ gas from a first tank 20, 100% $SiH_4$ gas from a second tank 21, $B_2H_6$ gas diluted to 200 ppm with $H_2$ from a third tank 22, and $O_2$ gas from a fifth tank 24, with each output pressure gauge adjusted to 1 kg/cm$^2$, into mass flow controllers 30, 31, 32, 34, respectively. The mass flow controllers were adjusted to achieve an overall flow rate of 600 sccm, to supply $SiH_4$ at a flow rate of 100 sccm and $O_2$ at 1 sccm and to give the $B_2H_6/SiH_4$ ratio of 20 as listed in Table 1. In this state, the gases were admitted into the reaction chamber 37. After the gas flow stabilized, the internal pressure of the reaction chamber 37 was adjusted to 1.0 torr. On the other hand, an aluminum drum, 80 mm in diameter and serving as the electrically conductive substrate 4, was preheated to 250° C. When the gas flows and the internal pressure stabilized, a high-frequency power supply 38 was turned on to apply power of 250 watts (frequency: 13.56 MHz) across electrodes 39 to cause glow discharge. The glow discharge was continued for about 5 hours to form on the substrate 4 a first layer 2 having a thickness of about 30 μm and containing a-Si, hydrogen, boron and a trace of oxygen.

When the first layer 2 was formed, the power supply 38 was turned off, the mass flow controllers were set to a flow rate of 0, and the reaction chamber 37 was fully degassed. Subsequently, a second layer and then a third layer were formed under the conditions listed in Table 1.

Indicated at 23 is a tank containing $C_2H_4$, which is usable in place of oxygen.

TABLE 1

| | 1st layer | 2nd layer | 3rd layer |
|---|---|---|---|
| Overall flow rate (sccm) | 600 | 600 | 600 |
| $SiH_4$ (sccm) | 100 | 100 | 100 |
| $O_2$ (sccm) | 1 | 1 | 1 |
| $B_2H_6/SiH_4$ | 20 | 1 | 20 |
| Temperature of substrate (°C.) | 250 | 250 | 250 |
| Power for discharge (W) | 250 | 250 | 250 |
| Gas pressure (torr) | 1.0 | 1.0 | 1.0 |
| Thickness of layer (μm) | 30 | 2 | 3 |

Figure 4:
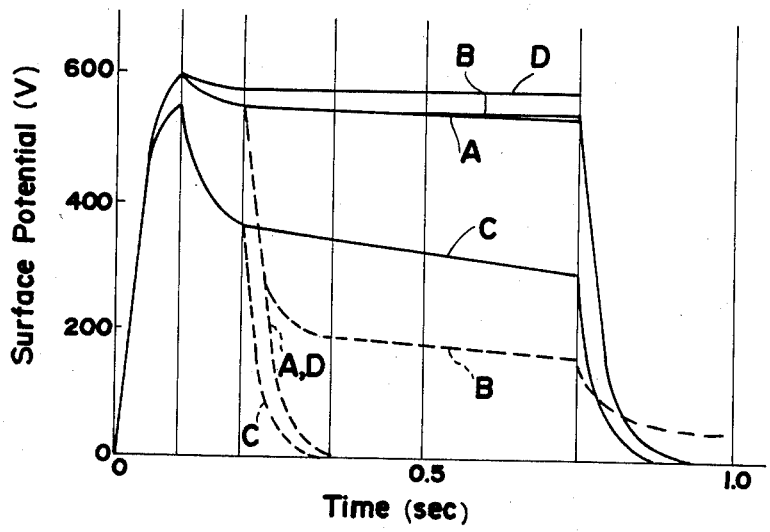
FIG. 4 is a diagram showing the variation of potential involved in the image forming process of the invention.
Figure 5:
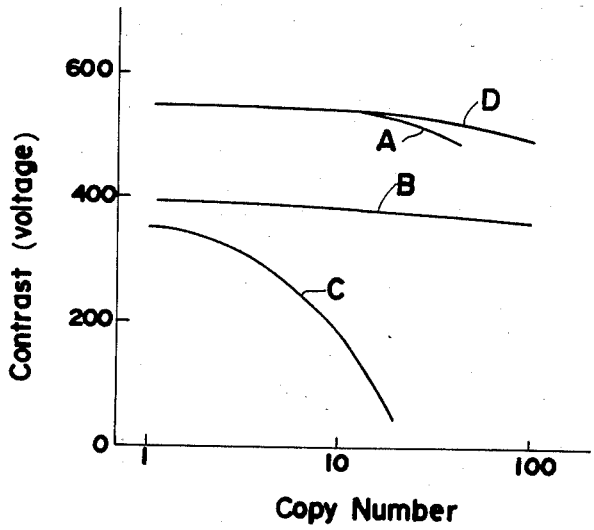
FIG. 5 is a diagram showing the variation of contrast voltage with the increase in the number of copies produced.

The photosensitive member obtained was tested for performance using the printer shown in FIG. 2. FIGS. 4 and 5 show the results.

In FIG. 4, curves A represent the variation of the surface potential on the photosensitive member A of the present example with the progress of the process. The solid line indicates the potential at the non-irradiated area, and the broken line the potential at the irradiated area. The dark decay after the exposure by the short-wavelength light source 11 was very small, and even when laser light was applied for writing, almost no residual potential occurred. Consequently highly contrasty sharp copy images were obtained. When copies were made continually from the same latent image, up to 50 copies obtained by continuous operation retained the high contrast as seen in FIG. 5.

EXAMPLE 2

A photosensitive member B1 was prepared using a slightly larger amount of oxygen for the second layer than in Example 1 as listed in Table 2. The member was similarly tested.

The member B1 of the present example achieved the same results as those represented by curves A in FIGS. 4 and 5, affording copy images of high contrast. Moreover, when tested by continuous copying operation, the member B1 produced 70 copies of high contrast, thus attaining a more improved result than the member of Example 1.

TABLE 2

| | 1st layer | 2nd layer | 3rd layer |
|---|---|---|---|
| Overall flow rate (sccm) | 600 | 600 | 600 |
| $SiH_4$ (sccm) | 100 | 100 | 100 |
| $O_2$ (sccm) | 1 | 10 | 1 |
| $B_2H_6/SiH_4$ | 20 | 1 | 20 |
| Temperature of Substrate (°C.) | 250 | 250 | 250 |
| Power for discharge (W) | 250 | 250 | 250 |
| Gas pressure (torr) | 1.0 | 1.0 | 1.0 |
| Thickness of layer (μm) | 30 | 2 | 3 |

Next, a photosensitive member B2 was prepared, with the amount of oxygen further increased by 70 sccm. The member B2 was comparable or superior to the above members in surface potential retentivity as indicated by curve B in FIG. 4, but residual potential occurred when laser light was used for writing. Although the member was found to be equivalent or superior to the member B1 in performance as tested by continuous copying operation, the residual potential resulted in a lower electrostatic contrast. In addition, the residual charges were not completely removable by the eraser lamp 17 alone.

EXAMPLE 3

A photosensitive member C was prepared, using a larger amount of $B_2H_6$ than in Example 1, i.e. 15 ppm, for the second layer as given in Table 3. The member was similarly tested. The results are shown by curves C in FIGS. 4 and 5.

TABLE 3

| | 1st layer | 2nd layer | 3rd layer |
|---|---|---|---|
| Overall flow rate (sccm) | 600 | 600 | 600 |
| $SiH_4$ (sccm) | 100 | 100 | 100 |
| $O_2$ (sccm) | 1 | 1 | 1 |
| $B_2H_6/SiH_4$ | 20 | 15 | 20 |
| Temperature of substrate (°C.) | 250 | 250 | 250 |
| Power for discharge (W) | 250 | 250 | 250 |
| Gas pressure (torr) | 1.0 | 1.0 | 1.0 |
| Thickness of layer (μm) | 30 | 2 | 3 |

As represented by curves C in FIG. 4, the photosensitive member C of the present example exhibited a very great reduction in surface potential when exposed to light of short wavelength over the entire surface, subsequently showing a markedly impaired surface potential retentivity in the dark. The member therefore failed to provide a sufficient electrostatic contrast. When tested by continuous operation, the member was unable to produce a multiplicity of copies from the same latent image because the contrast diminished rapidly as represented by curve C in FIG. 5.

EXAMPLE 4

A photosensitive member was prepared wherein the second layer had a smaller thickness than in Example 1 as listed in Table 4. The member was similarly tested.

TABLE 4

| | 1st layer | 2nd layer | 3rd layer |
|---|---|---|---|
| Overall flow rate (sccm) | 600 | 600 | 600 |
| $SiH_4$ (sccm) | 100 | 100 | 100 |
| $O_2$ (sccm) | 1 | 10 | 1 |
| $B_2H_6/SiH_4$ | 20 | 1 | 20 |
| Temperature of substrate (°C.) | 250 | 250 | 250 |
| Power for discharge (W) | 250 | 250 | 250 |
| Gas pressure (torr) | 1.0 | 1.0 | 1.0 |
| Thickness of layer (μm) | 30 | 0.05 | 3 |

Consequently, it was impossible to obtain copies of high contrast by continuous operation as in Example 3.

EXAMPLE 5

A photosensitive member D was prepared in the same manner as in Example 2 except that a charge injection preventing layer was formed between the first layer and the substrate under the conditions listed in Table 5. Curves D in FIGS. 4 and 5 show the results achieved.

TABLE 5

| | Preventing layer | 1st layer | 2nd layer | 3rd layer |
|---|---|---|---|---|
| Overall flow rate (sccm) | 600 | 600 | 600 | 600 |
| $SiH_4$ (sccm) | 100 | 100 | 100 | 100 |
| $O_2$ (sccm) | 3 | 1 | 10 | 1 |
| $B_2H_6/SiH_4$ | 500 | 20 | 1 | 20 |
| Temperature of substrate (°C.) | 250 | 250 | 250 | 250 |
| Power for discharge (W) | 250 | 250 | 250 | 250 |
| Gas pressure (torr) | 1.0 | 1.0 | 1.0 | 1.0 |
| Thickness of layer (μm) | 0.3 | 30 | 2 | 3 |

The photosensitive member D of the present example produced a very high electrostatic constrast as in Example 2. When tested by continuous operation, the member continually produced 100 copies of high image quality as represented by curve D in FIG. 5.

What is claimed is:

1. A photosensitive member which comprises:

a conductive substrate;

a first layer including amorphous silicon: germanium for absorbing light of long wavelengths;

a second layer formed on said first layer and including amorphous silicon and an element form Group IIIA or VA of the Periodic Table, said element from Group IIIA being included to establish a positive minority carrier for positive charging and elements from Group VA being included to establish a negative minority carrier for negative charging; and a third layer formed on said second layer and including amorphous silicon, said third layer absorbing light of short wavelengths wherein the thickness ofthe third layer is from 0.5 to 5 microns.

2. A process for forming images which comprises:

a first step of charging a photosensitive member to a predetermined surface potential of a first polarity, said photosensitive member including a conductive substrate, a first layer containing amorphous silicon: germanium, a second layer formed on said first layer and containing amorhpous silicon and an element from Group IIIA or VA of the Periodic Table to serve as a rectifying layer wherein charges of the same polarity as that of the first polarity act as minority carrier, and a third layer formed on said second layer and including amorphous silicon;

a second step of uniformly exposing said photosensitive member to light of short wavelengths wherein the short wavelength light is substantially absorbed by said third layer;

a third step of exposing said photosensitive member to an optical image by a long wavelength light source to form an electrostatic latent image;

a fourth step of developing said electrostatic latent image; and a fifth step of transferring the developed image onto a transfer member.

3. A process for forming images as cliamed in claim 2 wherein the electrostatic latent image formed in said third step is repeatedly used to make a plurality of copies by repeating said fourth and fifth steps.

4. A process for forming images as claimed in claim 2 further including a sixth step of exposing said photosensitive member to light of long wavelengths to erase residual charges.

5. A process of forming images which comprises:

a first step of charging a photosensitive member to a predetermined surface potential of first polarity, said photosensitive member including a conductive substrate, a first layer containing amorphous silicon: germanium, a second layer formed on said first layer and containing amorphous silicon and an element from Group IIIA or V A of the Periodic Table to serve as a rectifying layer wherein charges of the same polarity as that of the first polarity act as minority carriers, and a third layer formed on said second layer and including amorphous silicon;

a second step of exposing said photosensitive member to a short wavelength light of 400 to 500 nm thereby generating charge carriers to trap charges having the same polarity as said first polarity at the interface between said second and third layers;

a third step of exposing said photosensitive member to an optical image by a long wavelength light source whereby charge carriers are generated in said first layer and charges of the polarity opposite to the first polarity drift to neutralize the charges trapped at said interface to form an electrostatic latent image;

a fourth step of developing the electrostatic latent image; and a fifth step of transferring the developed image.

6. A process for forming images as claimed in claim 5 wherein the electrostatic latent image formed in said third step is repeatedly used to make a plurality of copies by repeating said fourth and fifth steps.

7. A process for forming images as claimed in claim 5 further including a sixth step of exposing said photosensitive member to light of long wavelengths to erase residual charges.

* * * * *